United States Patent [19]

Kaga

[11] 4,437,262

[45] Mar. 20, 1984

[54] MAGNETIC AMUSEMENT DEVICE

[75] Inventor: Takashi Kaga, Tokyo, Japan

[73] Assignee: Tomy Kogyo Co., Inc., Japan

[21] Appl. No.: 359,160

[22] Filed: Mar. 17, 1982

[30] Foreign Application Priority Data

Mar. 18, 1981 [JP] Japan ..... 56-38852

[51] Int. Cl.[3] ..... A63H 33/26

[52] U.S. Cl. ..... 46/242; 273/1 M; 40/426

[58] Field of Search ..... 46/242, 241, 240, 236, 46/238, 45; 273/1 M, 345; 40/426, 46, 273

[56] References Cited

U.S. PATENT DOCUMENTS 2,648,158 8/1953 Young ..... 46/242 X 3,782,726 1/1974 Huffman et al. ..... 46/240 X

*Primary Examiner*—Mickey Yu

*Attorney, Agent, or Firm*—K. H. Boswell; Edward D. O'Brian

[57] ABSTRACT

A magnetic amusement device incorporates a housing having a first and second magnetic member movably mounted on the housing. Each of the first and second magnetic members are capable of moving in a pathway with respect to the housing. The pathways of the two magnetic members are located in association with each other such that there is a point of association between the first and the second magnetic member. A ferromagnetic object is utilized in association with the first and second magnetic member such that the ferromagnetic object is capable of being associated with one of the first or second magnetic members as that one member moves in its pathway and when the first and second magnetic members are located at the point of association of the members the ferromagnetic member is capable of becoming disassociated with one of the members and becoming associated with the other of the members.

12 Claims, 9 Drawing Figures

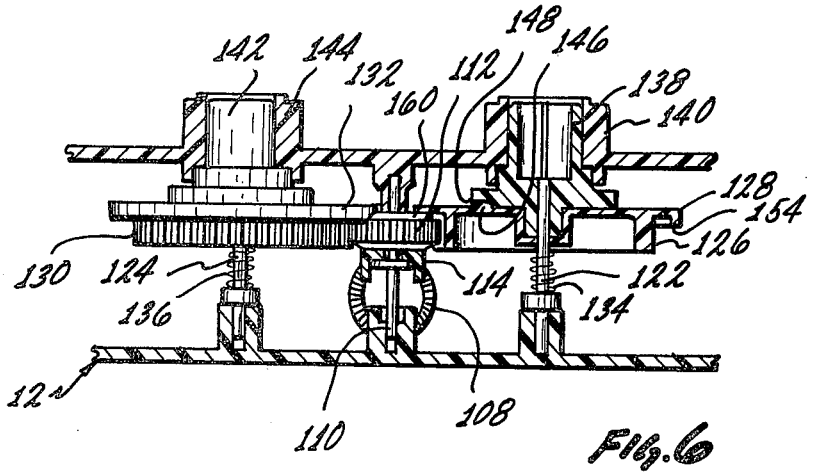
Fig. 6
Fig. 7
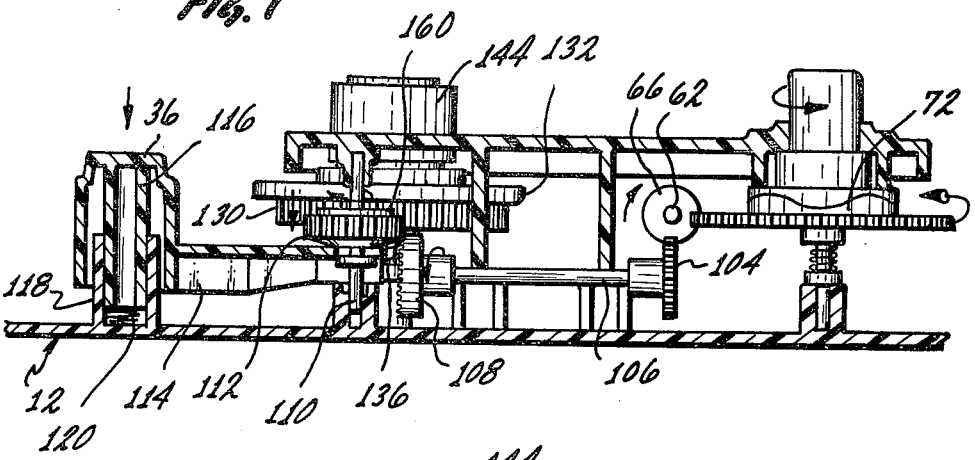
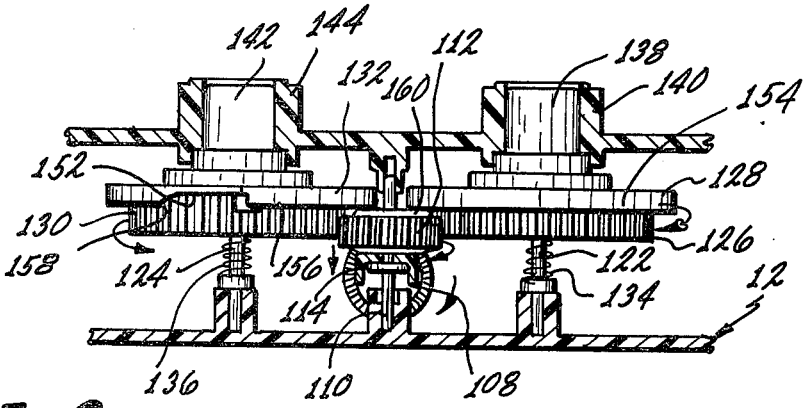
Fig. 8

MAGNETIC AMUSEMENT DEVICE

BACKGROUND OF THE INVENTION

This invention is directed to an amusement device which incorporates a housing having at least two magnetic members located thereon. A ferromagnetic object is utilized in conjunction with the members and is transferred from one of the members to the other of the members as the members move in cyclic pathways on the device. Preferredly, more than two magnetic members are utilized such that complex transfer of the ferromagnetic object back and forth among the members is possible.

The phenomena of magnetism, while understood and utilized in devices such as electric motors, generators and the like, for the most part still remains somewhat of a mystic phenomena, wherein unseen forces attract or repel objects. A mysticism still surrounds magnetism for the general segment of the population. Certain prior art entertainment devices have been devised which utilize magnets and magnetism therein to create certain effects.

Many pendulum, or suspension type devices such as those disclosed in U.S. Pat. Nos. 4,011,674; 4,091,565; 3,955,315; 4,012,038; 4,250,659; 3,312,470 and 2,277,672 are known. Other devices, such as the device disclosed in U.S. Pat. No. 4,043,558 utilize magnets on solid surfaces to cause attraction or repulsion of other magnetic objects, and further, a top-like magnet is disclosed in U.S. Pat. No. 3,466,796, which is capable of moving downwardly on a spiral support surface. While all of these devices are entertaining and interesting, they are, with the possible exception of U.S. Pat. Nos. 3,312,470 and 4,043,558, only observational devices and are not games of skill.

It is considered that in the class of games commonly referred to as games of skill, little advantage has been taken of the magnetic phenomena. None of the above noted U.S. patents describe games wherein a player is challenged in utilizing the game to utilize his skills to move an object from one magnetic member to the next. It is considered that an amusement device which combines the magnetic phenomena with a game of skill would be extremely entertaining and fascinating to the player thereof.

BRIEF DESCRIPTION OF THE INVENTION

In view of the above, it is a broad object of this invention to provide an amusement device which incorporates the magnetic phenomena therein in combination with a game of skill. It is a further object to provide a device wherein a ferromagnetic object is transferred from one magnet to the next in attempts in completing a pathway across the housing of the device. It is a further object to provide a device, which, because of its simplicity of manufacture and design, is both economically produced and thus can be made available to the general public at a low cost, but is still engineered such that it is capable of a useful lifetime yet still provide for a challenging and interesting game.

This and other objects, as will become evident from the remainder of this specification, are achieved in an amusement device which comprises a housing, a first magnetic member movably mounted on said housing, said first magnetic member capable of moving in a first cyclic pathway with respect to said housing, a second magnetic member movably mounted on said housing, said second magnetic member capable of moving in a second cyclic pathway with respect to said housing, moving means associated with said first magnetic member and said second magnetic member for moving said members in their respective said pathways, said first and said second cyclic magnetic members capable of being located in association with each other at a point of association in their respective pathways, an object formed of a ferromagnetic material and capable of being attracted to and reversibly magnetically held to each of said magnetic members, said object capable of being associated with one of said first or said second magnetic members as said one of said first or said second magnetic members moves in its cyclic pathway and when said first and said second magnetic members are located at said point of association said object capable of becoming disassociated with said one of said first or said second magnetic member and becoming associated with the other of said first or said second magnetic member.

Preferredly, both the first and second magnetic members travel in a circular pathway each of which is located adjacent to the other on the housing. Preferredly, the orbital speed of the first and second magnetic members are different, such that they do not become located in their point of association on each orbit around the circular pathway, but only become located at said point of association during what is seemingly random orbits.

A third magnetic member can be located in association with the first and second magnetic members. The third magnetic member would move in a third cyclic pathway with respect to the housing. The third magnetic member would be independently associatable with both the first and second magnetic members at a point of association in the respective pathways. The object would be capable of being associated at any one time with the first, second or third magnetic member. It would be transferrable between the first and second magnetic members, the first and third magnetic members or the second and third magnetic members at the point of association between the respective pathways of these magnetic members. The object would be capable of disassociating with the one of the first, second or third magnetic member with which it is associated, and becoming associated with the other of the members which are concurrently at the point of association.

Preferredly, the first and second magnetic members would be capable of continuously moving in their respective pathways with the third magnetic member being capable of independently moving in its pathway. Preferredly, each of the first, second and third cyclic pathways would be circular pathways located adjacent to one another on the housing.

Additional magnetic members can be added to the above described. Thus, a fourth and fifth magnetic member can be located on the housing. The fourth and fifth magnetic member, as well as the third magnetic member noted above, and the first and second magnetic member are capable of being moved by the moving means such that along with the other members noted previously, the fourth and fifth magnetic member would move in a fourth and fifth cyclic pathway respectively. Preferredly, the fourth magnetic member could associate with the second magnetic member and the fifth magnetic member could associate with both the second and the fourth magnetic member, with the first and second magnetic members being associated as described above, and the third magnetic member being associated with the first and second magnetic members as described above. As with the other magnetic members, the object would be capable of being associated with one magnetic member and move to the next. Preferredly, the first, second and fourth magnetic members would be a linear arrangement and it would be possible for the object to be passed from the first, to the second, to the fourth magnetic member. The third and fifth magnetic members could be associated adjacent to this linear arrangement of the first, second and fourth, such that it would be possible to pass the object from the first to the third, and then to the second magnetic member, or from the second to the fifth and then to the fourth magnetic member. Of course, the reverse of the above pathways is also possible.

As outlined above, the first, second and fourth magnetic members would constitute a first group of magnetic members with the third and fifth magnetic members constituting a second group of members. The first, second and fourth magnetic members would be aligned in a sequential association with one another, preferredly a linear association. The members of the second group, that is the third and fifth magnetic members would be independently associatable with members of the first group of magnetic members.

BRIEF DESCRIPTION OF THE DRAWINGS

The invention described in this specification and claimed in the claims appended hereto will be better understood when taken in conjunction with the drawings wherein:

FIG. 6 is a front elevational view in partial section about the line 6—6 of FIG. 2;

FIG. 7 is a side elevational view in partial section about the line 7—7 of FIG. 2 and, in fact, corresponds to FIG. 5 with certain of the components shown in a different spatial relationship than that seen in FIG. 5;

FIG. 8 is a front elevational view in partial section about the line 8—8 of FIG. 2 and, in fact, shows the same components as seen in FIG. 6, with some of these components shown in a different spatial relationship than as seen in FIG. 6.

Figure 1:
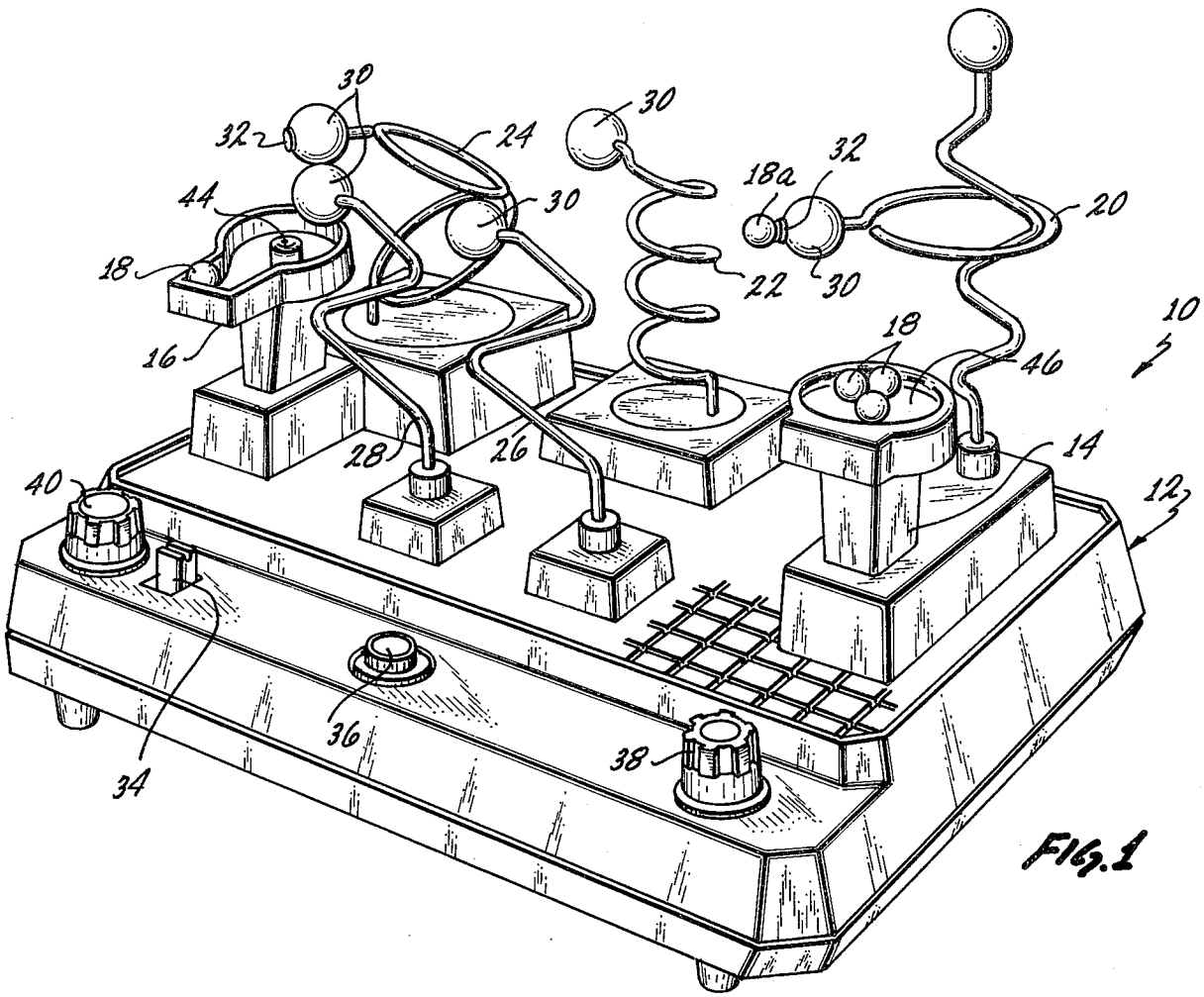
FIG. 1 is an oblique view of the preferred embodiment of the invention.

The invention described in this specification and illustrated in the drawing utilizes certain principles and/or concepts as are set forth in the claims appended to this specification. Those skilled in the toy arts will realize that these principles and/or concepts are capable of being utilized in a variety of embodiments differing from the exact embodiment utilized for illustrative purposes herein. For this reason, this invention is not to be construed as being limited to the exact illustrated embodiment herein, but is only to be construed in view of the claims.

DETAILED DESCRIPTION OF THE INVENTION

In FIG. 1. the amusement device 10 of the invention is illustrated. It utilizes a housing 12 which has a plurality of raised projections located thereon. The first of these is a start platform 14 seen on the right hand side of FIG. 1. On the left hand side of FIG. 1 is a goal platform 16. Collectively identified by the numeral 18 are a plurality of ferromagnetic objects. Three of these can be seen on start platform 14 and one of them is located on goal platform 16. Additionally, one other of these objects **18*a* is seen suspended above and to the left of start platform 14**.

Located in a linear sequence near the back edge of the housing 12 are first magnetic support member 20, hereinafter called first member, second magnetic support member 22, hereinafter called second member, and fourth magnetic support member 24, hereinafter called fourth member. Positioned between the start and goal platforms, 14 and 16 respectively, are third magnetic support member 26, hereinafter called third member, and fifth magnetic support member 28, hereinafter called fifth member.

Each of the support members 20, 22, 24, 26 and 28 have a plastic sphere collectively identified by the numeral 30 attached thereon. Attaching to each of the plastic spheres 30 on each of the members 20, 22, 24, 26 and 28 is a circular magnetic element, collectively identified by the numeral 32. The plastic spheres 30 serve to hold the magnetic elements 32 such that they are essentially projecting horizontally from the respective members 20, 22, 24, 26 and 28. The magnetic elements 32 are each of sufficient magnetic strength to attach and hold one of the ferromagnetic objects.

As will be discussed below, the members 20, 22, 24, 26 and 28 rotate on the housing 12. The rotation of members 20, 22, 24, 26 and 28 causes the magnetic element 32 located thereon to orbit in a circular pathway. These circular pathways do not cross one another, but they position the magnetic elements 32 with respect to one another such that the distance between the two magnetic elements 32 on two adjacent members, as for example, members 20 and 22, is approximately the same diameter as is the diameter of the spherical objects 18.

An off/on button 34 projects upwardly from the housing 12. When the off/on button 34 is pushed forward to the on position, a motor, hereinafter identified and described, located within the housing 12 causes rotation of the first, second and fourth magnetic members 20, 22 and 24 respectively. These members continue to rotate as long as the off/on button 34 is in the "on" position. To the right of the off/on button 34 is an activation button 36. When the activation button 36 is momentarily depressed, the third and fifth members 26 and 28 rotate one complete orbit from the position as seen in FIG. 1, counterclockwise back to this position. Each time the activation button 36 is depressed, these two members 26 and 28 rotate this one orbit. If, in fact, the activation button 36 is depressed and maintained in a depressed position, the members 26 and 28 will continuously orbit. As soon as the activation button 36 is released, they will complete their present orbit until they assume their position as seen in FIG. 1, at which point they will stop.

On the forward right hand side of the housing 12 is a knob 38. On the forward left hand side of the housing 12 is a corresponding knob 40. As will hereinafter be explained in greater detail, when these knobs 38 and 40 are rotated approximately one fourth of a turn, a cylindrical member, member 42 in start platform 14 and member 44 in the goal platform 16, project upwardly. The inside surface 46 of the start platform 14 is concave such that any objects 18 located therein tend to center themselves. At the center of this surface 46 is an opening (not separately identified or numbered) through which the cylindrical member 42 passes. When the knob 38 is turned, the member 42 is raised and any object 18 located in the center of the surface 46 becomes located on the top of the member 42, which can be raised up to a height equal in height to the placement of the magnetic element 32 on the first member 20. When so placed, as the first member 20 rotates, the magnetic element 32, as it passes cylindrical member 42, will attract the object **18*a* and the object 18*a* becomes attached to the magnetic element 32 as is depicted in FIG. 1**.

The object of the game is to pass the object **18*a* from the magnetic element 32 on the first member 20 to the corresponding magnetic element either on the second member 22 or the third member 26. When the object 18 becomes so located on the second member 22, whether it was directly from the member 20 or via the member 26, it can then be passed to either the fourth member 24 or the fifth member 28. If passed to the member 28, it is then the object to pass it to the member 24. In any event, if and when the object 18 becomes located on the member 24, the knob 40 is turned, raising the cylindrical member 44 through the opening in the goal platform 16 such that when the fourth member 24 rotates, the magnetic element 32 located thereon passes very close to the raised member 44, which knocks off the object 18 off of the magnetic element 32 onto the fourth member 24 such that it falls and becomes located on the goal platform 16. The goal platform 16 slopes to the front such that the objects 18 become located in the squarish shaped receptacle in the front of the goal platform 16**.

The first member 20 rotates at a different orbital speed from the second member 22, which in turn rotates at a different orbital speed from the fourth member 24. Thus, the magnetic elements 32 located on these respective members only become located adjacent to one another at seemingly random intervals or random rotations of these respective members. If left to chance, eventually, the magnetic elements 32 on two of the adjacent rows of elements 20, 22 and 24 will come close together. However, it is preferred that this only happen at lengthened intervals such that the element of skill must be utilized in playing the amusement device 10, and not simply leaving things to chance.

It is the idea in playing the amusement device 10 to utilize the fourth and fifth members 26 and 28 to retrieve the objects 18 from the other members and transfer them to the next adjacent member. Thus, the third member 26 would be utilized to retrieve an object 18 from the member 20 and then convey that object to the member 22, and likewise, the fifth member 28 would be utilized to convey the object 18 from the member 22 to the member 24. It is, of course, realized that activation of the activation button 36 must be precisely timed to start the rotation of the members 26 and 28 such that they are capable of retrieving the object 18 from the appropriate other members. If the activation of the members 26 and 28 via the activation button 36 is ill timed, the magnetic element 32 on the members 26 and 28 will not pass close enough to the magnetic elements 32 on the members 20, 22 and 24 to attract the object 18 from them.

It is possible to thus move the object 18 from the goal platform 16 to the member 20, from there to the member 26, from there to the member 22, from there to the member 28 and from there to the member 24, and from there to deposit the object 18 in the goal platform 16. It is also possible to move the object 18 from the start platform 14 to the first member 20, from there to the second member 22, from there to the fourth member 24 and into the goal platform 16. Conversely, it is possible, however it is more difficult and thus requires a greater degree of agility and skill, to move the objects 18 in the reverse pattern, from the goal platform 16 to the start platform 14, via three, four or five of the members 20, 22, 24, 26 and 28. During play of the game, it is also possible for the direction of the objects 18 to be reversed and for the objects 18 to go in the opposite direction. As for example, assuming that one was attempting to move the object 18 from the start platform 14 to the goal platform 16, and the object had been successfully located on the second member 22 with attempts to move it to the fourth member 24, if the object 18 was not successfully moved to either the member 24 to the member 28 before member 20 or member 22 becomes located in a position wherein their magnetic elements 32 are close to one another, the object 18 could become reattached to the first member 20, thus reversing the forward progress and penalizing the player playing the amusement device 10.

Figure 2:
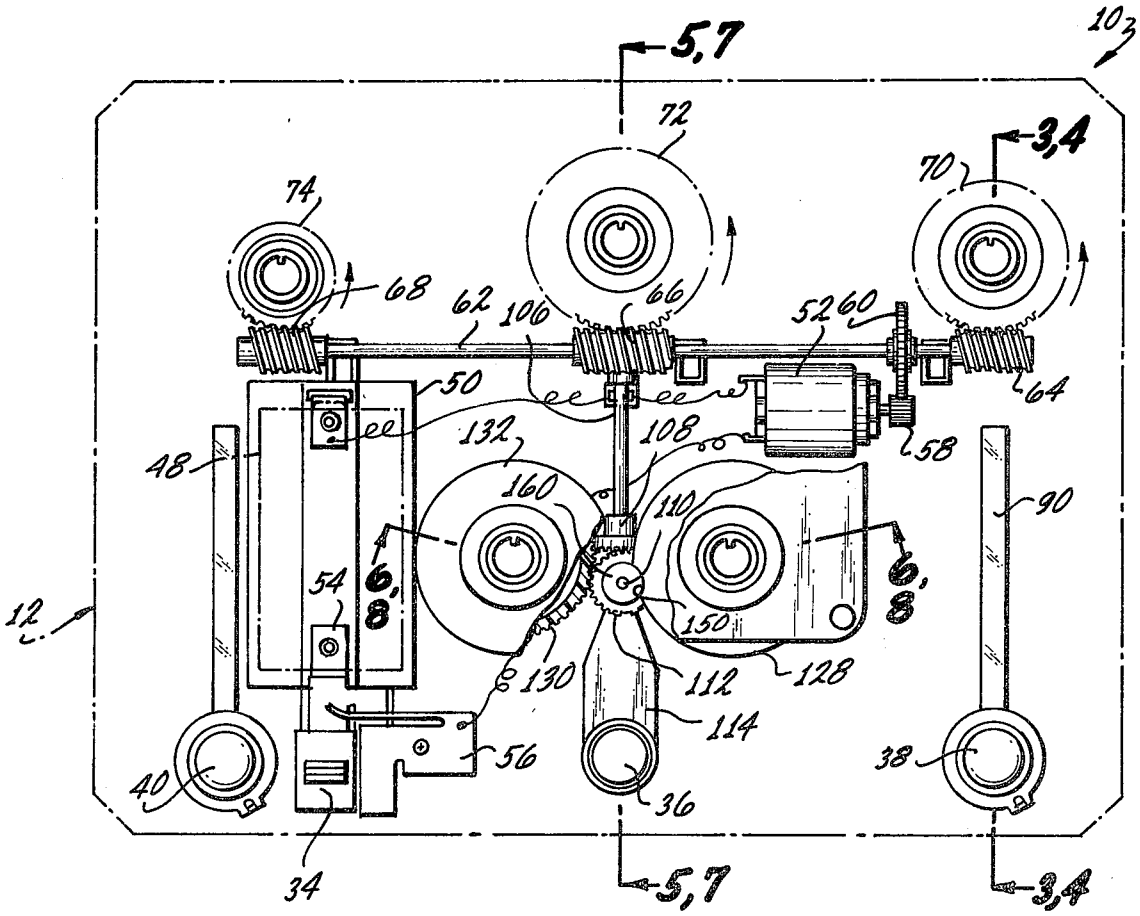
FIG. 2 is a top plan view of the embodiment of FIG. 1 with certain overlaying components removed to show parts located underneath.

Referring now to FIG. 2, which shows a plan view of the inside of the housing 12, a battery 48 is seen located within the appropriate battery compartment 50. A lead from the battery 48 goes to a motor 52, with a second lead of the battery 48 going to an electrical contact 54. A second electrical contact 56 is in association with the contact 54 with electrical contacts 54 and 56 being made when the off/on button 34 is pushed to the "on" position. A lead from the contact 56 compeltes an electrical circuit to the motor 52.

A pinion 58, located on the shaft of the motor 52 is meshed with a spur gear 60 which is fixed to an elongated shaft 62. The elongated shaft 62 has three worm gears located thereon, gears 64, 66 and 68 respectively. The worm gears 64, 66 and 68 thus turn in response to rotation of the motor 52. A spur gear 70 meshes with worm gear 64 for eventually causing rotation of first member 20; likewise, a spur gear 72 meshes with worm gear 66 for rotating member 22 and a third spur gear 74 meshes with worm gear 68 for rotation of member 24. The members 20, 22, and 24 each have a clutch mechanism which isolates them from the shaft 62 such that, if, inadvertently, one of these members is fixedly held while the amusement device 10 is in the "on" position and the motor 52 is rotating, damage to the internal components is prevented. The attaching and clutch mechanism for the three members 20, 22 and 24 is identical, and therefore only the attachment and clutch mechanism for member 20, which is shown in FIG. 3, will be described in detail, it being sufficient to note that the attachment and clutch mechanism for the other two shafts 22 and 24 operate on the exact same principle and utilize identical mechanical components.

Figure 3:
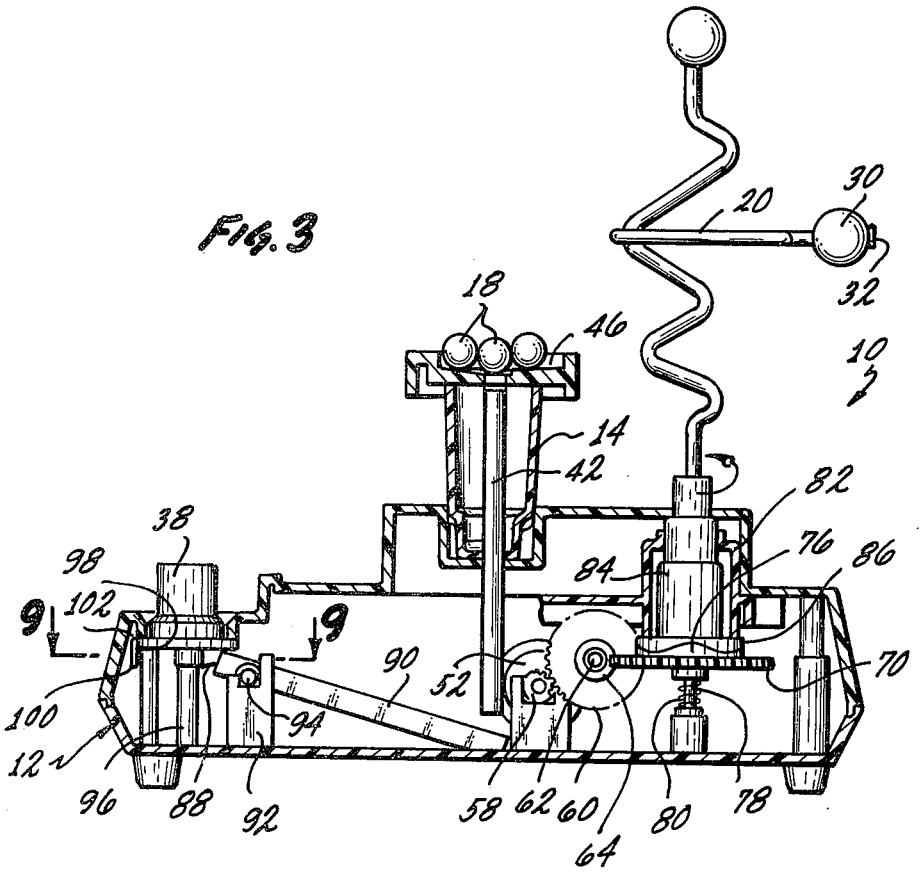
FIG. 3 is a side elevational view in partial section about the line 3—3 of FIG. 2.

In viewing FIG. 3, the spur gear 70 is seen in a horizontal alignment. Fixedly formed on the top of spur gear 70 is a re-entrant gear 76. The spur gear 70 and the re-entrant gear 76 freely rotate about a shaft 78. A spring 80 is also around shaft 78 and biases spur gear 70 and re-entrant gear 76 upwardly. Formed within the housing 12 is a cage 82. An upstanding boss 84 is located within the cage 82 and located on the bottom of the boss 84 is re-entrant gear 86. Re-entrant gear 86 mates with re-entrant gear 76 under normal circumstances. If, for any reason, the member 20 is rotated when the motor 52 is not in an "on" position, or if the member 20 is fixedly held when the motor 52 is in an "on" position, the re-entrant gears 86 and 76 slip with respect to one another by downward movement of the re-entrant gear 76 and the spur gear 70 against the bias of the spring 80. Normally, the spring 80 maintains the two re-entrant gears 76 and 86 in engagement with one another. The location of the cage 82 around the boss 84 prevents upward movement of the re-entrant gear 86 and boss 84.

The first member 20 frictionally attaches to the boss 84 by fitting inside of it, and spins in conjunction with the rotation of the boss 84. The housing 12 contains appropriate bearing surface (not identified or numbered) allowing for projection of the member 20 through the housing 12, and allowing for free rotation of the member 20 with respect to the housing 12.

The spur gears 70, 72 and 74 are of different diameters and contain a different number of teeth located thereon. Because of this, the orbital speed of the members 20, 22 and 24 is different. Fourth member 24, having the smallest diameter spur gear 74, orbits at a much faster rate of rotation. First member 20, which has a medium sized spur gear 70 moves at an intermediate speed, and second member 22 orbits at the slowest speed because its spur gear 72 is larger than the spur gear 70. This results in the above noted misalignment during some of the orbits of the magnetic elements 32 on the members 20 and 22 with respect to one another and the members 22 and 24 with respect to one another. In one embodiment of the invention, the magnetic elements 32 on the members 20 and 22 would only be aligned once every six rotations or orbits of the second member 22 and the magnetic elements 32 on members 22 and 24 would be aligned for two rotations of the member 22, followed by non-alignment for six rotations. As is evident, this requires the utilization of the third and fifth members 26 and 28 respectively, if one wishes to move one of the objects 18 as rapidly as possible from the first member 20 via the second member 22 to the fourth member 24 and to prevent reverse movement. When two of the members 20 and 22 or 22 and 24 become aligned, the object 18 can move backwards to a previous member.

Figure 4:
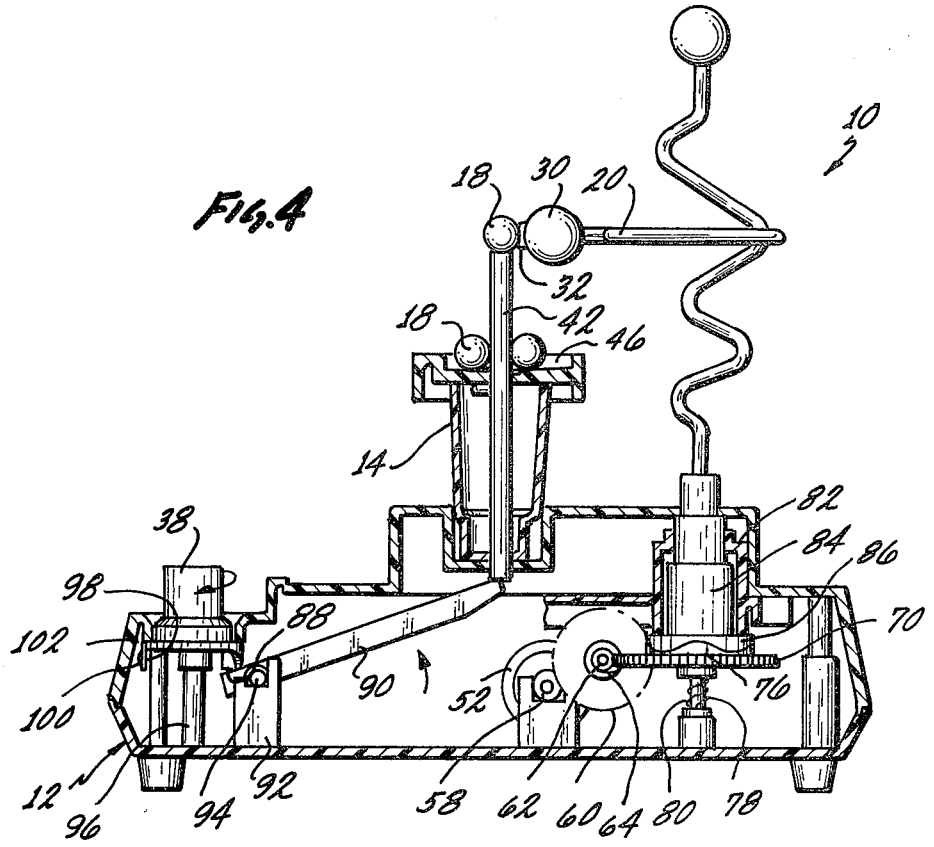
FIG. 4 is a side elevation view in partial section about the line 4—4 of FIG. 2 and, in fact, corresponds with FIG. 3, with the exception that certain of the components are shown in a different spatial relationship in FIG. 4 than in the spatial relationship shown in FIG. 3.
Figure 9:
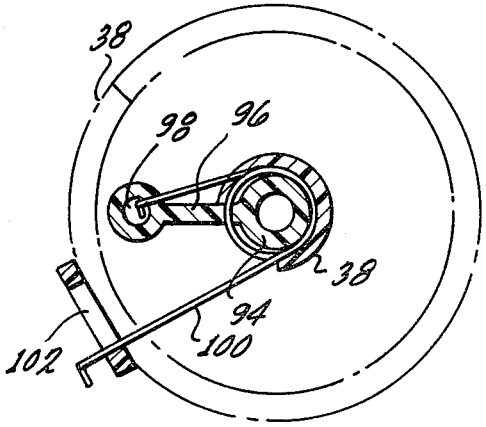
FIG. 9 is a top plan view in section about the line 9—9 of FIG. 3.

Referring now to FIGS. 3 and 4, movement of the objects 18 from the start platform 14 to the magnetic element 32 on the member 20 is illustrated. FIG. 9 shows the biasing spring underneath the knob 38 which returns it to its rest position. Movement of the member 44 in the goal platform 16 is exactly analagous as to that which will be described for the member 42 illustrated in FIGS. 3 and 4, and thus will not be duplicated. Equivalent parts to those described in FIGS. 3 and 4 for the start platform 14 exist for the goal platform 16.

On the underneath side of the knob 38 is a tapered cam surface 88. A lever 90 is pivoted about support 92 via axles 94 integrally formed with the lever 90 such that one of its ends lays underneath knob 38 against the cam surface 88. Upon rotation of the knob 38 the cam surface progressively pushes down against this end of the lever 90, raising the opposite end. The opposite end is located directly underneath the cylindrical member 42. When this opposite end is raised, its upward movement is transferred to the circular member 42, raising the same. This movement can be seen in moving from FIG. 3 to FIG. 4. As is seen in FIG. 3, one of the objects 18 is centered directly over the cylindrical member 42 and when the cylindrical member 42 is raised, the object is raised to a position such that it can be captured by the magnetic element 32 located on the first member 20.

The knob 38 rests on an upstanding boss 94 which is formed as part of an upstanding projection 96. The projection 96 includes a hole 98. A spring 100 has one of its ends bent downwardly such that it fits into the hole 98. The spring 100 wraps around the boss 94 and the other of its ends fits through a slot 102 formed on the outside of the knob 38. This biases the knob 38 in a counterclockwise direction as seen in FIG. 9. Rotation in a clockwise direction results in movement of the lever 90 and tenses the spring 100 against its bias such that when the knob 38 is released, the bias of the spring 100 rotates the knob 38 counterclockwise, which in turn allows the lever 90 to move back to the position seen in FIG. 3, allowing the cylindrical member 42 to descend back to the start platform 14.

Referring now to FIGS. 2 and 5 through 8, a pinion 104 also meshes with worm gear 66. Pinion 104 is attached to shaft 106, which extends perpendicular to shaft 62. On the other end of shaft 106 is a crown gear 108. The shaft 106 is appropriately journaled within bearing surfaces formed as a part of the housing 12, as is shaft 62 and the other rotating elements of the device 10.

A shaft 110 is journaled within the housing 12 such that it is free to be raised and lowered and to rotate. The shaft 110 carries a pinion 112 located thereon. Resting underneath the pinion 112 is extension 114, extending from the activation button 36. A central core 116 of the activation button 36 fits within an appropriate hollow boss 118, formed as a part of the housing 12. A compression spring 120 is located below the core 116 inside of boss 118, and biases the activation button 36 upwardly.

Figure 5:
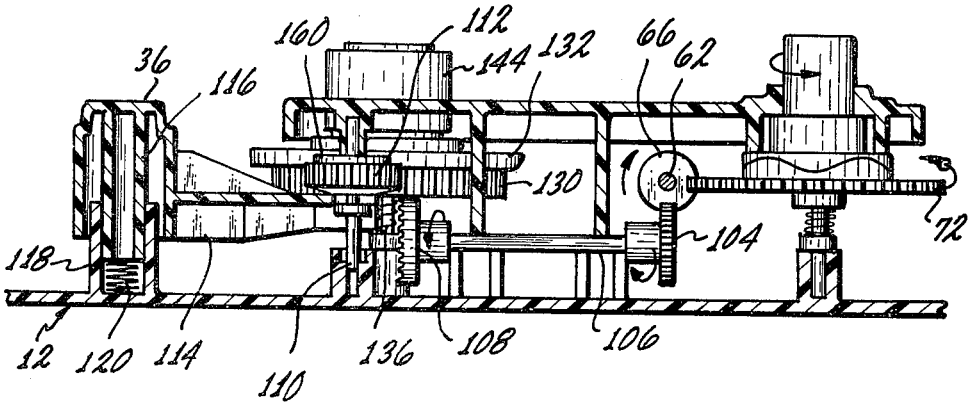
FIG. 5 is a side elevational view in partial section about the line 5—5 of FIG. 2.

The movement of the shaft 110 and the pinion 112 are dependent upon the movement of the activation button 36, as is evident from viewing FIGS. 5 and 7. When the activation button 36 is depressed, this allows the pinion 112 and the shaft 110 to descend downwardly and pinion 112 to mesh with crown gear 108. When the pinion 112 is in a raised position in response to activation button 36 being biased upwardly by the spring 120, the pinion 112 does not mesh with the crown gear 108. In the downward position, the pinion 112 engages the crown gear 108 such that rotary motion from the shaft 62 is transferred via the shaft 106 to the pinion 112.

Located to the right of shaft 110 is a shaft 122, and located to the left of shaft 110 is a shaft 124. The shafts 122 and 124 are appropriately journaled in the housing 112. A large spur gear 126, having a disk 128 integrally formed on its top surface, is mounted about the shaft 122. Likewise, a spur gear 130 with a similar disk 132 is located on shaft 124. A spring 134 biases spur gear 126 and disk 128 upwardly on shaft 122, and a spring 136 performs the same function for spur gear 130 and disk 132 on shaft 124. An upstanding boss 138 fits within a cage 140 formed on the housing 112 and is positioned against the top of disk 128. Likewise, a boss 142 is located within a cage 144 and is positioned against the top of disk 132. The spring 134 biases the spur gear 126 and disk 128 upwardly against the bottom of the boss 138 to frictionally engage it, and the spring 136 performs a like function in biasing the disk 132 against the bottom of the boss 142. A small detent 146 located on disk 128 fits into a small notch 148 on the bottom side of boss 138. This assists in frictional engagement of boss 138 with the disk 128. However, the detent 146 can slip out of the notch 148 if the spring 134 is compressed. If for some reason the third member 26 is restrained while the disk 128 was spinning, as hereinafter described, the detent 146 would slip free of the notch 148 and break the frictional engagement between the disk 128 and the boss 138 to ensure that the amusement device would not be damaged. Likewise, an identical unseen detent and notch are also located on the disk 132 and on the boss 142 to prevent damage to the fifth member 28.

As seen in FIG. 2, the disk 128 has a notch 150 in its periphery. Likewise, the disk 132 has a notch 152 in its periphery. This is evident from viewing FIG. 8. On the underside of the disk 128 is a skirt 154. Likewise, on the underside of disk 132 is a skirt 156. There is a break in skirt 154 in the area of the notch 150 and likewise a break in the skirt 156 in the area of notch 152. As is seen in FIG. 8 for skirt 156 at the area wherein the break is located, the skirt is wedge shaped at the area 158. Not seen in the FIGS. would be the analagous structure on the skirt 156 near the area of notch 150.

On top of the pinion 112 is a flange 160. As is evident from viewing FIG. 2, the flange 160 is sized and shaped such that it can fit in both of the notches 150 and 152. As is evident from viewing FIGS. 6 and 8, the flange 160 is capable of fitting underneath the skirts 154 and 156 when it is not located within the notches 150 and 152.

As seen in FIG. 5, when the activation button 36 is raised under the bias of spring 120, the pinion 112 is not engaged with the crown gear 108. At this time, the flange 160 is located within the notches 150 and 152 and the spur gears 126 and 130 are restrained from any rotation because of the location of the flange 160 within the notches 150 and 152. When the activation button 36 is depressed, the spur gear 112 descends and engages with the crown gear 108, causing rotation of the spur gear. At the same time, the flange 160 moves downwardly out of engagement with the notches 150 and 152. Pinion 112 is in continuous engagement with the spur gear 126 and 130 and when the pinion 112 rotates in response to rotation of crown gear 108, this also rotates these spur gears and their disks 128 and 130 integrally formed with them. As the disks rotate, the wedge shaped areas 158 on the skirts 154 and 156 engage the top of the flange 160 and maintain the pinion 112 in its downward position in engagement with the crown gear 108. The skirts 154 and 156 ride over the top of the flange 160 and maintain the pinion 112 in this position.

When the spur gears 126 and 130, with their attached disks 128 and 132, and the members 26 and 28, have made one complete rotation, the notches 150 and 152 are again aligned over the flange area 160 on the pinion 112. This allows the pinion 112 and the flange 160 to move upwardly under the bias of the spring 120, acting through the activation button 36 and its extension 114. This raises the pinion 112 upwardly such that it disengages with the crown gear 108. Rotation of the spur gears 126 and 130 therefore cease when the pinion 112 is no longer engaged with the crown gear 108. This, in turn, stops the rotation of the third and fifth members 26 and 28. The third and fifth members 26 and 28 then can be made to rotate one complete rotation upon each depression of the activation button 36. Of course, if the activation button 36 is maintained in a downward position, this overrides the bias of spring 120 and the pinion 112 is not urged upwardly by the extension 114 and stays in engagement with the crown gear 108, maintaining the third and fifth members 26 and 28 continuously rotating.

I claim:

1. An amusement device which comprises:

a housing;

a first magnetic member movably mounted on said housing, said first magnetic member capable of moving in a first cyclic pathway with respect to said housing;

a second magnetic member movably mounted on said housing, said second magnetic member capable of moving in a second cyclic pathway with respect to said housing;

motor means associated with said first magnetic member and said second magnetic member for continuous moving said members in their respective said pathways;

each of said first and second cyclic pathways are circular pathways and are located adjacent to one another on said housing;

the orbital speed of said first magnetic member in its pathway being greater than the orbital speed of said second magnetic member in its pathway;

said first and said second magnetic members capable of being located in association with each other at a point of association of their respective pathways;

an object formed of a ferromagnetic material so as to be attracted to and temporarily magnetically attachable to each of said magnetic members;

said object capable of being temporarily magnetically attached to one of said first or said second magnetic members as said one of said first or said second magnetic members moves in its cyclic pathway and when said first and said second magnetic members are located at said point of association said object further capable of becoming detached from said one of said first or said second magnetic members and becoming magnetically attached to the other of said first or said second magnetic member.

2. An amusement device which comprises:

a housing;

a first magnetic member movably mounted on said housing, said first magnetic member capable of moving in a first cyclic pathway with respect to said housing;

a second magnetic member movably mounted on said housing, said second magnetic member capable of moving in a second cyclic pathway with respect to said housing;

a third magnetic member movably mounted on said housing, said third magnetic member capable of moving in a third cyclic pathway with respect to said housing;

moving means associated with said first, said second and said third magnetic members for moving said members in their respective pathways;

said first and said second magnetic members capable of being located in association with each other at a point of association of their respective pathways;

said second and said third magnetic members capable of being located in association with one another at a point of association of their respective pathways;

said third and said first magnetic members capable of being located in association with one another at a point of association of their respective pathways;

an object formed of a ferromagnetic material so as to be independently attracted to and temporarily magnetically attachable to each of said magnetic members, said object when magnetically attached to any one of said magnetic members transferable to any other one of said magnetic members when said one of said magnetic members and said other one of said magnetic member are located at their respective point of association.

3. The device of claim 2 wherein:

said first and said second magnetic members are capable of continuously moving in their respective pathways and said third magnetic member is capable of intermittently moving in its pathway.

4. The device of claim 3 wherein:

each of said first, said second and said third cyclic pathways are circular pathways and are located adjacent to one another on said housing.

5. The device of claim 4 including:

a fourth magnetic member movably mounted on said housing, said fourth magnetic member capable of moving in a fourth cyclic pathway with respect to said housing;

a fifth magnetic member movably mounted on said housing, said fifth magnetic member capable of moving in a fifth cyclic pathway with respect to said housing;

said fourth magnetic member and said second magnetic member being located in association with each other at a point of association of their respective pathways;

said fifth magnetic member being located in association with each of said second and said fourth magnetic members at points of association of their respective pathways;

both said fourth and said fifth magnetic members associated with said moving means so as to be moved by said moving means in their respective pathways;

said object capable of being transferred between said first and said second, said second and said third, said first and said fourth, said second and said fourth, said second and said fifth and said third and said fifth members when said respective members are located at the respective points of association of the respective pathways of said respective members.

6. The device of claim 5 wherein:

fourth magnetic member is capable of continuously moving in its pathway and said fifth magnetic member is capable of intermittently moving in its pathway.

7. An amusement device which comprises:

a housing;

a plurality of magnetic members movably mounted on said housing, each of said plurality of magnetic members capable of moving independently in a cyclic pathway with respect to said housing;

moving means located on said housing for moving each of said members in their respective cyclic pathways;

said plurality of magnetic members divided into a first group of members and a second group of members, said first group including at least two of said members, said second group including at least one of said members;

said members of said first group sequentially associated with one another;

any member of said second group independently association with at least one member of said first group;

an object formed of ferromagnetic material so as to be independently attracted to and temporarily magnetically attachable to each of said magnetic members;

said object capable of being associated with and magnetically attached to any one of said members and then transferred to a further member by becoming associated with and magnetically attached to said further member so as to allow (a) transfer of said object between members of said first group by transfer of said object between adjacent members of said first group and (b) transfer of said object between said first group and said second group by transfer of said object between members of said first group and said second group which are associated with one another.

8. The device of claim 7 wherein:

said first group of said plurality of magnetic members are capable of continuously moving in their respective pathways.

9. The device of claim 8 wherein:

any member of said second group is capable of intermittently moving in its respective pathway.

10. The device of claim 9 wherein:

said first group is located in a linear sequence with respect to one another.

11. The device of claim 10 wherein:

each of said plurality of magnetic members moves in a circular pathway.

12. The device of claim 11 wherein:

each of said first group of said plurality of magnetic members moving with a different orbital speed than the member immediately adjacent to it in said linear sequence.

* * * * *